United States Patent [19]

Bondi

[11] 3,957,555

[45] *May 18, 1976

[54] METHOD OF MAKING PILE FABRIC HAVING AN ADHESIVE SUBSTRATE

[75] Inventor: Emanuele Bondi, Milan, Italy

[73] Assignee: Fieldcrest Mills, Inc., Eden, N.C.

[ * ] Notice: The portion of the term of this patent subsequent to Nov. 12, 1991, has been disclaimed.

[22] Filed: July 22, 1974

[21] Appl. No.: 490,227

Related U.S. Application Data

[63] Continuation-in-part of Ser. No. 363,832, May 25, 1973, Pat. No. 3,847,692, which is a continuation-in-part of Ser. No. 54,751, July 14, 1970, abandoned.

[30] Foreign Application Priority Data

July 24, 1969 Italy ..... 20100/69
Dec. 12, 1969 Italy ..... 25744/69

[52] U.S. Cl. ..... 156/72; 156/231; 156/289; 156/435; 156/501

[51] Int. Cl.[2] ..... B32B 5/00; B32B 31/12; B32B 31/18

[58] Field of Search ..... 156/72, 176, 177, 230, 156/231, 232, 247, 248, 251, 289, 435, 494, 495, 501, 516, 519, 520

[56] References Cited

UNITED STATES PATENTS

| | | | |
|---|---|---|---|
| 2,101,905 | 12/1937 | Hopkinson | 156/435 |
| 2,358,368 | 9/1944 | Victor | 156/72 |
| 2,784,630 | 3/1957 | Koprow et al. | 156/72 |
| 3,477,889 | 11/1969 | Partensky | 156/72 |
| 3,580,761 | 5/1971 | Boultinghouse | 156/72 |
| 3,847,692 | 11/1974 | Bondi | 156/435 |

FOREIGN PATENTS OR APPLICATIONS

| | | | |
|---|---|---|---|
| 140,288 | 3/1953 | Sweden | 156/72 |
| 1,040,286 | 8/1966 | United Kingdom | 156/72 |
| 1,131,023 | 2/1957 | France | 156/72 |
| 790,498 | 2/1958 | United Kingdom | 156/72 |
| 1,031,333 | 6/1966 | United Kingdom | 156/435 |
| 92,725 | 6/1959 | Netherlands | 156/435 |

*Primary Examiner*—William A. Powell
*Assistant Examiner*—John E. Kittle
*Attorney, Agent, or Firm*—Bell, Seltzer, Park & Gibson

[57] ABSTRACT

A method of making pile fabrics in which a compacted block of strands of pile forming material is incrementally discharged from an open end of a container in successive increments of an amount equal to the desired length of pile and, following each discharge of the block from the container, a pile slice is severed from the block while being deposited directly onto and secured to an advancing layer of adhesive carried by a release surface to form a pile fabric of cut pile tufts secured to an adhesive substrate which is then removed from the release surface.

11 Claims, 7 Drawing Figures

FORM BLOCK OF PILE STRANDS
BELT
FORM SUBSTRATE BY DEPOSITING LAYER OF ADHESIVE ONTO RELEASE SURFACE
RELEASE PAPER
EMBED REINFORCING SCRIM INTO ADHESIVE SUBSTRATE
FORM PILE FABRIC BY SEVERING AND DEPOSITING PILE STRANDS ONTO ADHESIVE SUBSTRATE
CURING ADHESIVE SUBSTRATE
PEEL SUBSTRATE FROM RELEASE SURFACE
TAKE UP RELEASE PAPER
TAKE UP PILE FABRIC

METHOD OF MAKING PILE FABRIC HAVING AN ADHESIVE SUBSTRATE

This application is a continuation-in-part of my copending application Ser. No. 363,832, filed May 25, 1973, now U.S. Pat. No. 3,847,692 and entitled METHOD AND APPARATUS FOR MAKING PILE FABRICS FROM A BLOCK OF PILE YARNS, which is in turn, a continuation-in-part of my application Ser. No. 54,751, filed July 14, 1970, now abandoned.

This invention relates to pile fabrics and more especially to a method of making nonwoven pile fabrics such as carpets, rugs and the like having an adhesive substrate to which cut pile tufts are secured.

According to my aforementioned copending application Ser. No. 363,832, a highly efficient method and apparatus is disclosed for producing patterned pile fabrics at a relatively high rate of production, and wherein successive pile slices are severed from one end of a compact patterned block of substantially parallel pile yarns and, during the severing of each successive pile slice, it is progressively deposited onto an advancing adhesive-coated backing to thus connect each pile slice being formed to the backing while the backing is being advanced relative to the block of pile yarns. It has now been determined that high quality pile fabrics similar to those disclosed in the latter application may be produced by utilizing a layer of adhesive without a backing as the substrate for the pile fabric.

Accordingly, it is an object of this invention to provide an improved method of making pile fabrics utilizing an adhesive without a backing as the substrate for supporting and anchoring the pile material thereon.

It is a more specific object of this invention to provide a method of making pile fabrics in which a compacted block of parallel pile strands is utilized in a container as a source for the pile material and wherein the pile strands are fed from the block in successive increments of the desired length of pile with each successive fed increment being severed from the block and brought into contact with a layer of adhesive for securement thereto. The layer of adhesive forming the adhesive substrate is carried by a release surface formed by a suitable conveyor belt or release paper, from which the layer of adhesive is removed with the pile thereon after the adhesive is cured.

Some of the objects of the invention having been stated, other objects will appear as the description proceeds when taken in connection with the accompanying drawings, in which:

FIG. 3 illustrates a suitable apparatus for carrying out the successive stages of the method illustrated in FIG. 1;

Figure 1:
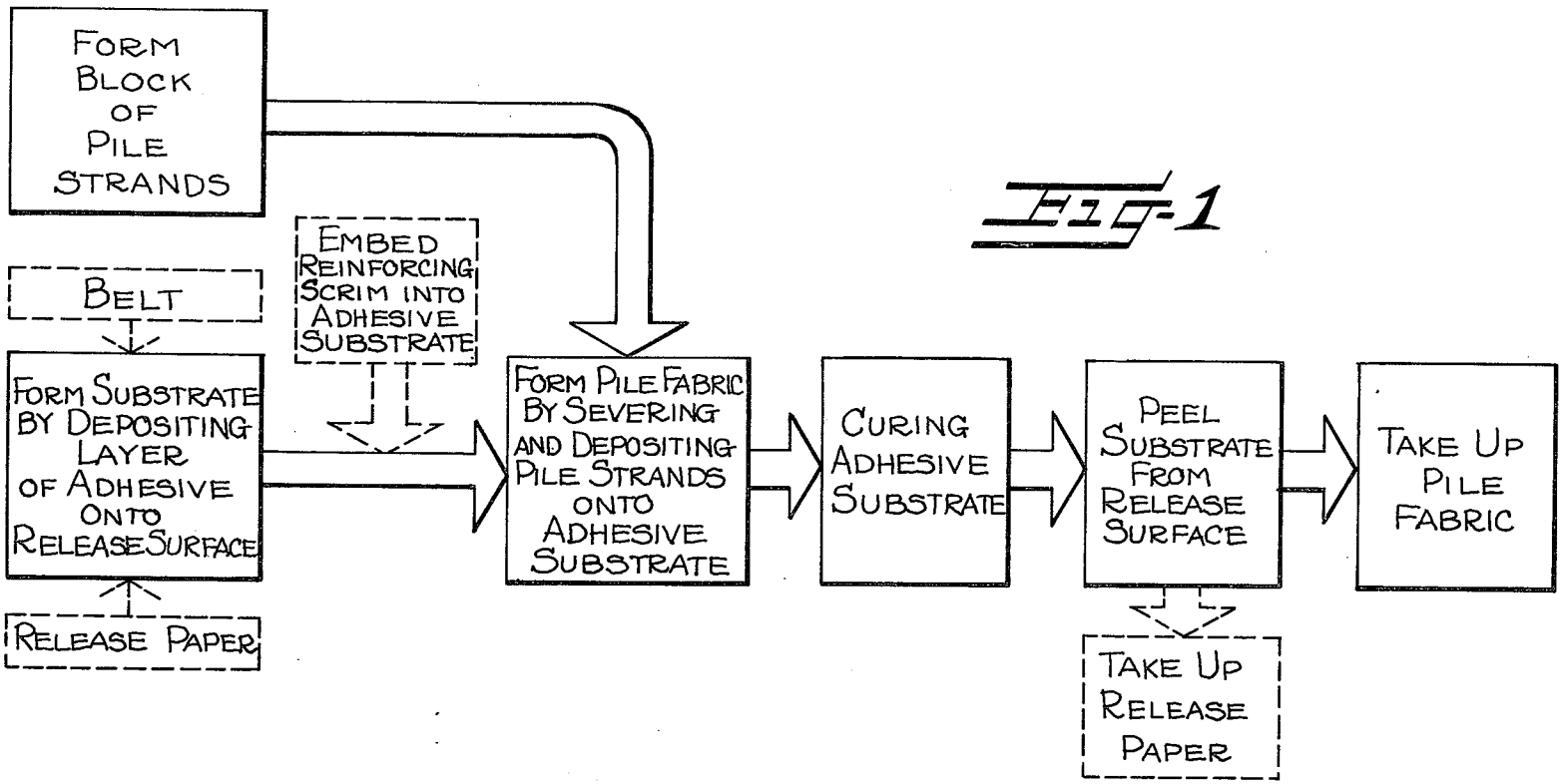
FIG. 1 is a block diagram illustrating successive stages in the preferred method of making pile fabrics utilizing a block of strands of pile forming material.

Referring more specifically to the drawings, and especially to FIG. 1, there is shown in solid-line blocks the preferred series of steps to be carried out in the performance of the method of this invention, and the brokenline blocks denote optional method steps which may be carried out in the performance of the method, if desired. As illustrated in the block diagram of FIG. 1, an adhesive substrate is formed by depositing a layer of liquid adhesive onto a release surface which may be in the form of a belt or a release paper whose adhesive receiving surface is characterized by the fact that a set or cured layer of a particular type of adhesive being used may be readily separated from the release surface. As further illustrated in FIG. 1, a block of pile strands is formed, and the block and the adhesive substrate are brought into cooperative relationship for forming the pile fabric by severing a pile slice from the end of the block and depositing the thus formed cut pile strands onto the adhesive substrate for securement thereto and to form transverse rows of cut pile tufts thereon.

If desired, as the layer of adhesive is being deposited onto the release surface, or thereafter but before the pile strands are deposited onto the adhesive substrate being formed, a reinforcing scrim may be embedded in the adhesive substrate. In any event, after each successive pile slice is severed from the block of pile strands and deposited onto the adhesive substrate, the adhesive substrate is cured or set to firmly anchor the lower ends of the thus formed cut pile tufts to the adhesive substrate.

The adhesive substrate with the tufts thereon then constitutes the pile fabric, such as a carpet, rug or the like, and the substrate then is peeled or otherwise separated from the release surface and taken up to form a roll thereof, if desired. As illustrated in FIG. 1, if the release surface is embodied in a release paper, the release paper may be taken up separately from the pile fabric after the adhesive substrate has been peeled away from the release paper.

Having thus described, in general, the steps performed in producing a pile fabric according to the method of this invention, a more detailed description thereof now will be given with reference to FIGS. 2–7 of the drawings wherein the steps of the method will be related to a suitable apparatus especially adapted for performing the method. The block of pile strands, and the apparatus with which such block of pile strands is used in forming the pile fabric, may be quite similar to that disclosed in said copending application Ser. No. 363,832. Therefore, for the sake of brevity of the instant disclosure, the disclosure of said copending application is incorporated herein by reference and only so much of the pile strand block and the related apparatus will be described as is deemed necessary to a clear understanding of the present invention.

Figure 2:
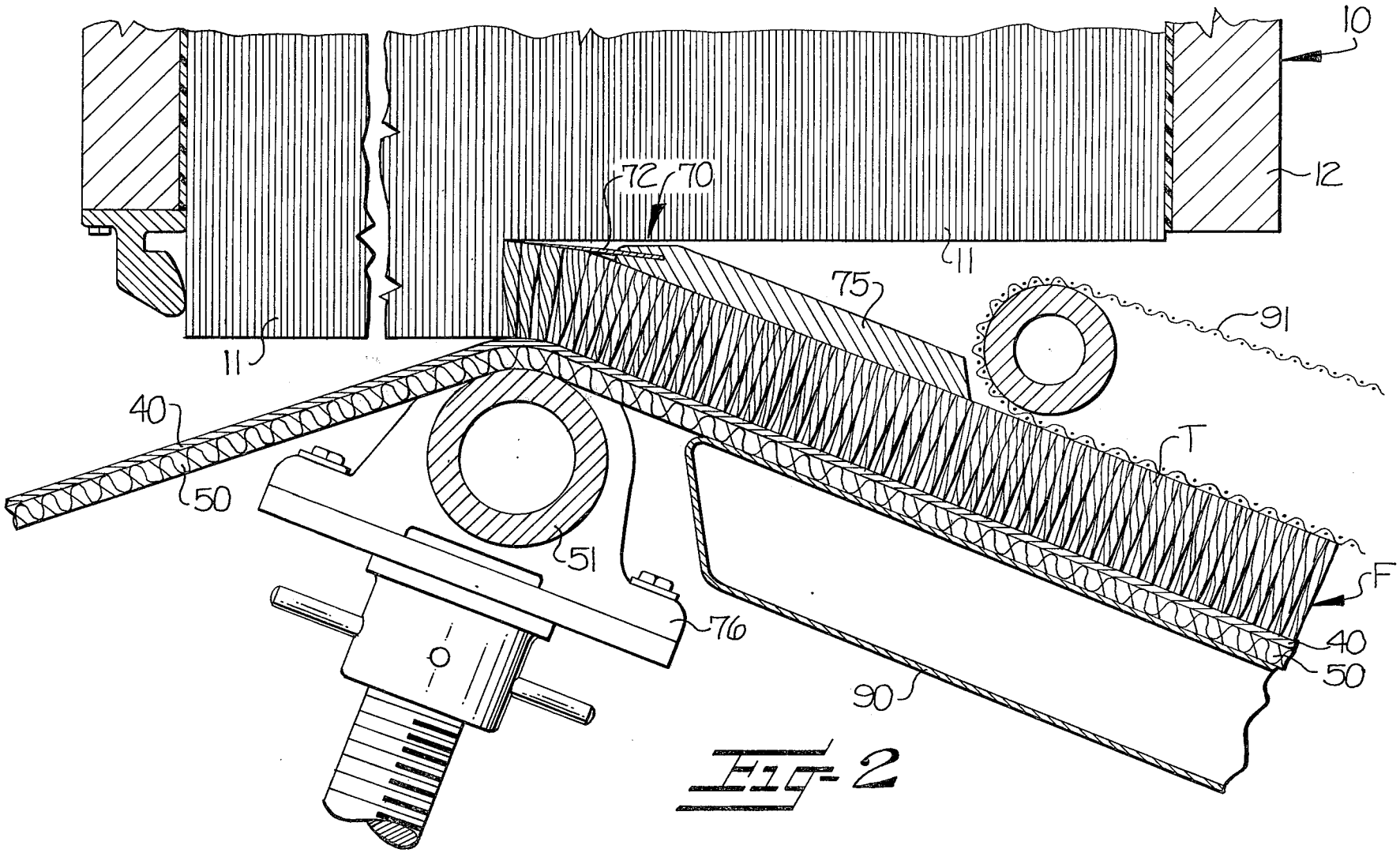
FIG. 2 is a fragmentary vertical sectional view illustrating the preferred manner in which each successive increment of pile strands is severed transversely of the pile strand axes to form a pile slice while the ends of the severed pile strands are being brought into contact with an adhesive substrate.

Referring to FIGS. 2 and 3, there is shown a confined or compacted block 10 of substantially parallel strands 11 of pile forming material arranged in transverse rows in an open-ended container 12. The pile strands 11 may be of any desired color, kind or size or combinations thereof, and may be of any desired type of pile forming material; e.g., carpet yarns, slivers, rovings and/or tows of synthetic continuous filaments, or any desired combination thereof. The block 10 is formed by arranging the pile strands 11 in substantially parallel relationship to form sheets or layers thereof. The arranging of the pile strands 11 may be carried out by any suitable method. As disclosed in my said copending application, for example, a patterned block of pile yarns or other pile strand material may be formed by weaving a fabric utilizing pile strands for the wefts thereof by interweaving a plurality of binder warp yarns with a plurality of weftwise pile strands, preferably of different colors arranged in a predetermined order. Thereafter, a compact stack of layers of the woven fabric is formed by folding the same into equal-length layers to form a stack of superposed fabric layers while aligning the successive layers with each other so that the ends of the pile strands 11 therein collectively form a composite pattern. The compact stack of folded fabric then is enclosed in an open-ended container 12 to form the confined block 10 of pile strands with the ends of the pile strands exposed and forming the composite pattern at an open end of the container. The pile strands 11 may be arranged in a random pattern of different types, colors, or shades. Also, it is contemplated that all of the pile strands 11 in block 10 may be white or of the same color and/or kind.

As shown in FIGS. 2 and 3, after the pile strand block 10 is formed, it is positioned in a suitable carriage 15 mounted for reciprocable movement in a substantially horizontal path on a frame 30. Thus, as preferred, container 12 is positioned so that the open-end thereof faces downwardly with the axes of pile strands 11 extending substantially vertically therein. At certain or periodic intervals, a downward force is applied periodically to a pressure plate 20 movable within and relative to container 12 and engaging the upper ends of all of the pile strands 11. In other words, pressure plate 20 is moved downwardly in a stepwise manner, as by a suitably electrically controlled motor 21, connected through mechanism 22, to rotary, internally threaded sleeves or nuts 23 carried by carriage 15. Substantially vertically disposed screws 23 are threaded through sleeves 23 and have their lower ends suitably connected to pressure plate 20 for imparting stepwise downward movement thereto.

With each stepwise downward movement of plate 20, plate 20 imparts a predetermined incremental downward movement to the compacted strand block 10 relative to container 12 so that the pile strands 11 are discharged from and project downwardly a predetermined distance below the lower end of container 12, which distance is at least equal to the desired length of pile. In any event, the amount of each increment of discharge of block 10 from container 12 is equal to the desired length of pile to be formed.

As heretofore indicated, with particular reference to FIG. 1, an adhesive substrate is formed by depositing a layer of adhesive onto a release surface. The adhesive substrate is indicated at 40 in FIGS. 2 and 4-7 and the release surface is embodied in an endless main conveyor belt 50 in FIGS. 2, 4 and 5. However, as indicated in broken lines in FIGS. 3 and 4, and in solid lines in FIG. 7, the release surface may be defined by a release paper 60, if desired. The release paper 60 may be drawn from a suitable supply roll 61 (FIG. 3) carried by the frame 30 of the pile fabric manufacturing apparatus.

The term "release paper" is used herein to mean any type of relatively thin sheet or film material having a release surface thereon from which a set or cured layer of the adhesive material being used may be readily separated. By way of example, a silicone-coated paper may be employed as the release paper 60.

If a release paper is utilized in the performance of the method, it must be adequately supported during formation thereon of adhesive substrate 40 and during the performance of other steps in the method. Accordingly, when belt 50 is not being used as the release surface for the adhesive substrate 40, it may serve as the support for the release paper 60. Of course, if the release paper 60 is positioned on belt 50 for receiving the layer of adhesive thereon of which the adhesive substrate is formed, it is apparent that belt 50 then need not necessarily be provided with a release surface thereon.

On the other hand, when a release paper is not being used, a suitable release surface must be provided on belt 50. By way of example, belt 50 may be in the form of a woven endless fiber glass web coated with a synthetic plastic material, such as, for example, Teflon, or with any other suitable material from which a set or cured layer of the adhesive material being used may be readily removed. It is thus seen that either the conveyor belt 50 alone or the release paper 60 passing over conveyor belt 50 may serve as the supported release surface for the adhesive substrate 40.

Various types of thermoplastic or thermosetting materials or mixtures thereof may be used for the adhesive of which substrate 40 is to be formed. The adhesive may be a plastisol or latex, or if desired, it may be in granular or powder form. Illustrative but non-limiting examples of suitable adhesive materials include polyvinyl chloride, polyurethane, natural or synthetic latex, urea resin, melamine resin, ethylene polyvinyl chloride, polyvinyl acetate copolymer, and/or any other suitable resin.

As indicated earlier herein, it will be observed in FIG. 3 that the pile strand block 10 is suitably supported for reciprocatory forward and rearward movement with carriage 15 in frame 30. Carriage 15 may be reciprocated by suitable sprocket and chain connections 32 between carriage 15 and an electric motor 33 carried by frame 30. The pile strand block 10 is shown occupying a rearward or inactive position rearwardly of a pile slice severing or cutting station broadly designated at 70. The rear portion of endless belt 50, rearwardly of severing station 70, extends upwardly and forwardly at a shallow angle underlying the pile strand block 10 when the block occupies the rearward or inactive position shown in FIG. 3.

Spaced below the path of travel of pile strand block 10, and positioned above the rear portion of the upper reach of endless belt 50, is a suitable adhesive applying or depositing station broadly designated at 41. The adhesive applying station 41 may be of any well-known type which will deposit relatively thin coating of liquid adhesive of the desired predetermined thickness upon the upper surface of endless belt 50 or onto the release paper 60, as the case may be, in the course of forward movement of the corresponding portion of belt 50 or release paper 60 to the severing station 70. Of course, adhesive applying station 41 is located so that substrate 40 is present on that portion of the belt passing through the severing station 70 and over a roller 51 as shown in FIGS. 2 and 3.

The liquid adhesive being deposited on belt 50 or release paper 60 may be of any desired thickness and is preferably of a thickness such that it will not rupture when it is being separated from the corresponding release surface after the pile slices have been secured to the adhesive substrate 40 and the adhesive substrate has been cured. By way of example, the liquid adhesive coating deposited on the release surface may be in the range of about 0.1 to 1.0 millimeter or more.

As shown in FIGS. 2 and 3, the endless belt 50 is so supported that the adhesive substrate 40 advances forwardly and passes upwardly in converging relation to the substantially horizontal path of travel of container 12 as container 12 is moved in an active or forward stroke thereof past severing station 70. The adhesive substrate 40 then passes downwardly from severing station 70 (FIGS. 2 and 4) in diverging relation to the path of container 12.

The supporting roll 51 for that portion of the upper reach of conveyor 50 passing through severing station 70 is spaced a predetermined distance below a stationarily mounted, transversely extending endless-band type of cutter blade 72 of severing station 70 (FIG. 2). Cutter blade 72 is positioned closely adjacent and beneath the path of container 12 and is arranged to sever successive pile slices from the lower end of the pile strand block projecting from the open lower end of container 12 so as to form the cut pile tufts T (FIGS. 2 and 4–7) during each forward stroke of container 12 past cutter blade 72.

It is thus seen that, as pile strand block 10 moves forwardly over the adhesive substrate 40 (FIG. 2) and the cutter blade 72 is cutting a pile slice from the corresponding increment of pile strands previously discharged from the lower end of container 12, the severed pile strands are brought into contact with the adhesive substrate 40 for securement thereto to form transverse rows of cut pile tufts T thereon. The adhesive nature of substrate 40 normally is adequate to insure effective securement of the cut pile tufts to substrate 40. However, if desired, during each successive forward movement of container 12, and before the leading edge of the pile yarn block 10 reaches cutter blade 72, the lower ends of the pile strands 11 may be coated with a suitable liquid adhesive material. To this end, it will be observed in FIG. 3 that, during each forward stroke of carriage 15 toward severing station 70, the lower end of block 10 passes in engagement with an applicator roll 42 of a suitable auxiliary adhesive applying device 43 stationarily positioned below the path of travel of pile strand block 10. Thus, by applying a coating or layer of liquid adhesive to the lower surface of pile yarn block 10 following the feeding of each successive increment thereof from container 12 and before block 10 reaches cutter blade 72 (FIG. 2) in the course of each forward movement of carriage 15, the thus applied adhesive on the lower surface of the pile slice being formed further aids in securement of the pile slice to the upper surface of adhesive substrate 40.

Referring again to severing station 70, with the exception of blade 72 (FIG. 2) having a smooth or straight cutting edge which faces rearwardly with respect to the direction container 12 is moving during the severing operation, the severing apparatus may be in the form of a conventional band saw assembly with the endless blade 72 being mounted on a pair of pulleys or wheels 73, only one of which is shown in FIG. 3, and which may be driven by an electric motor 74. Pulleys 73 are arranged so that cutter blade 72 occupies a substantially horizontal position transversely of the path of travel of pile strand block 10. As shown in FIG. 2, blade 72 may be guided and maintained in the latter position during movement thereof by a suitably slotted or grooved stationary guide bar 75 overlying the path of travel of adhesive substrate 40 and the cut pile tufts T of the now formed pile fabric F.

Since severing station 70 may be constructed and operated in substantially the manner disclosed in my said copending application Ser. No. 363,832, a further detailed description thereof is deemed unnecessary. It should be noted, however, that it is preferred that the supporting roll 51 at the pile strand severing station 70 is journaled in suitably adjustable bearings 76, only one of which is shown in FIG. 2, for adjusting roll 51 so that the path of travel of the upper surface of adhesive substrate 40 over roll 51 is substantially the same as that of the lower surface of pile yarn block 10 in the course of forward movement thereof. This facilitates the progressive depositing onto adhesive substrate 40 of transverse rows of tufts T as each successive pile slice is being severed from the lower end of block 10. Also, the height of roll 51 may be adjusted to accommodate changes in the extent of each incremental discharge of the pile strand block 10 which may be effected for obtaining different heights of pile tufts T on the adhesive substrate 40.

In the depositing of each successive pile slice onto adhesive substrate 40, the forward movement of the upper reach portion of endless belt 50 is correlated with each respective forward movement of pile strand block 10. Accordingly, it will be observed in the central portion of FIG. 3 that a suitable variable speed drive mechanism 80 drivingly connects electric motor 33 to the front supporting rollers of an upper endless conveyor belt 91 and the endless conveyor belt 50. Also, a suitable clutch means 81 is interposed between electric motor 33 and variable speed drive mechanism 80 for effecting forward movement of the proximal reach portions of belts 50, 91 only at such times as cutting blade 72 is being engaged by the forwardly moving pile strands 11 of block 10. It is preferred that the variable speed drive mechanism 80 is so adjusted as to advance the adhesive substrate 40 forwardly relative to the forwardly moving pile strand block 10 and at a faster rate than the rate of forward movement of pile strand block 10. It is apparent that this arrangement permits varying the density of the pile fabric F being formed and facilitates forming the pile tufts T in substantially clearly defined transverse rows across the pile fabric F.

As described earlier herein with respect to FIG. 1, the adhesive substrate is set or cured following the severing and depositing of cut pile strands onto the adhesive substrate. Accordingly, immediately after the adhesive substrate 40 passes over supporting roll 51 at severing station 70, the adhesive substrate 40 passes over and in close proximity to a heated hollow platen or plenum 90 which, as shown in FIG. 3, is engaged by the lower surface of the upper reach of endless conveyor belt 50. The upper surface of platen 90 is of a width at least about equal to that of the pile fabric F being formed and it may be heated by any suitable heating means, such as an electrical heater, or a circulating hot oil or other hot fluid. For example, if a polyvinyl chloride plastisol type of adhesive is being used for the adhesive substrate 40, platen 90 may be heated up to about 220° centigrade or higher for effecting curing or setting of the adhesive on the corresponding release surface. Thus, heated platen 90 forms a curing zone thereabove through which the pile fabric F is advanced from severing station 70 for curing the adhesive substrate 40 previously formed on the endless conveyor belt 50 or on the release paper 60, as the case may be.

To aid further in securing the cut pile tufts T to the adhesive substrate as the successive pile slices are being progressively deposited on the advancing substrate 40, the upper endless conveyor 91 serves as a pressure applying belt which is suitably supported above and extends throughout the width of pile fabric F as it moves above heated platen 90. As heretofore indicated, conveyor 91 is driven intermittently, by motor 33 and variable speed drive mechanism 80, at a rate corresponding to the rate at which pile fabric F is being advanced forwardly over heated platen 90. Also, the lower reach of conveyor 91 is spaced above the forward section of belt 50 a distance corresponding substantially to the desired height of pile tufts T combined with any thickness of the adhesive substrate 40 underlying the pile tufts T.

It is preferred that the spacing between the conveyor belts 50, 91 is such that the lower ends of the successive tufts T will be embedded in the adhesive substrate 40. As shown in FIG. 2, the lower reach of upper conveyor 91 is disposed immediately downstream of the blade guide bar 75 and cooperates therewith to press the deposited pile tufts T into or at least against the adhesive substrate 40 in its course along the downwardly inclined forward section of the upper reach of conveyor belt 50.

Figures 4, 5:
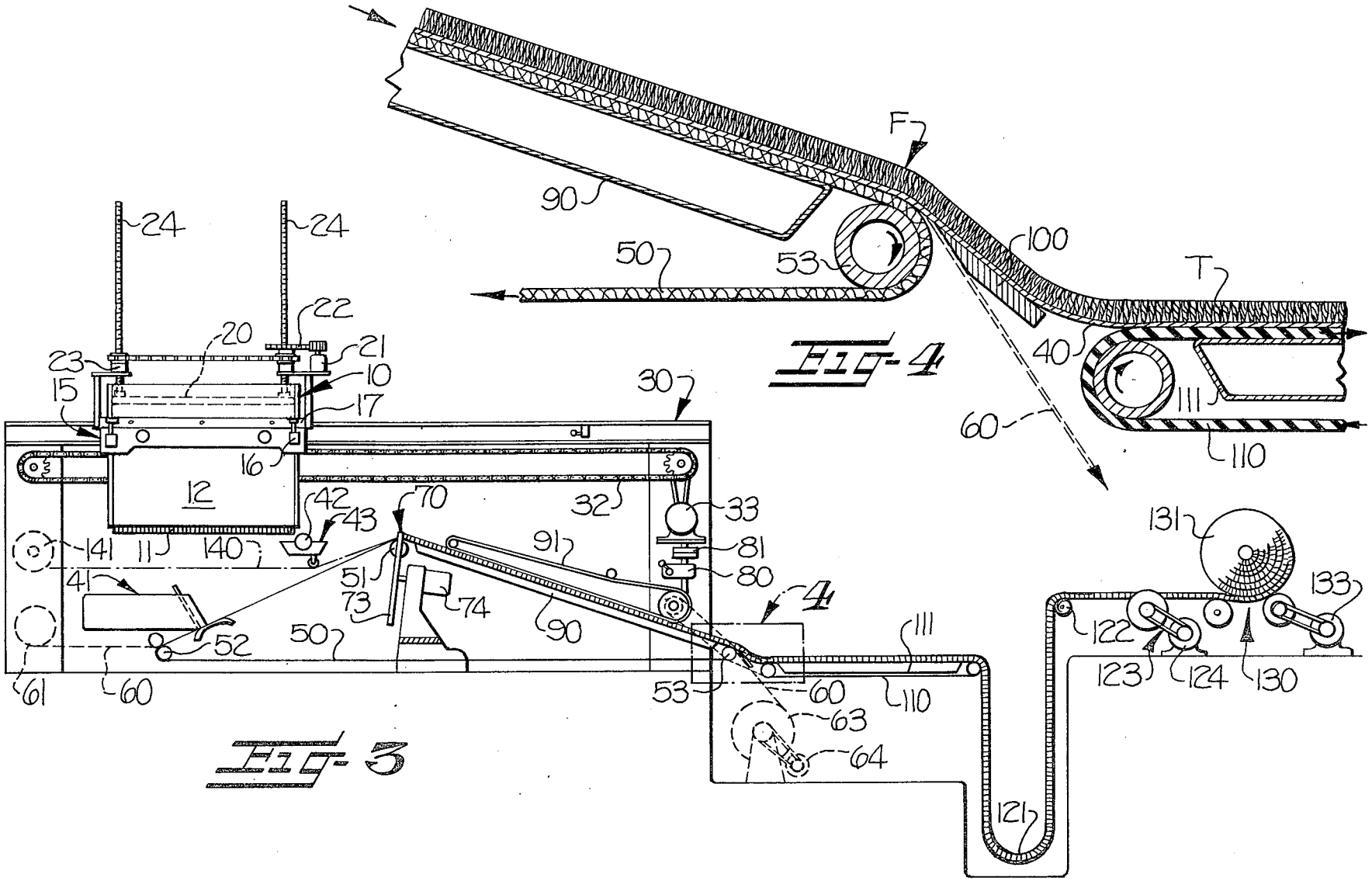
FIG. 4 is an enlarged fragmentary view of the area 4 outlined in broken lines in FIG. 3, and showing how the adhesive substrate may be separated from the release surface upon which the substrate was previously formed.
FIG. 5 is a fragmentary vertical sectional view similar to the central portion of FIG. 2, particularly illustrating a reinforcing scrim being introduced into the layer of adhesive forming the adhesive substrate before the pile strands are deposited on and secured to the substrate.

As shown in FIG. 3, the extreme rear and front portions of the endless main conveyor belt 50 are mounted on suitable respective rollers 52, 53 and, as the forward portion of the upper reach of main conveyor belt 50 passes downwardly over the front roller 53, the adhesive substrate 40 moves forwardly in diverging relation to the forward portion of conveyor belt 50. In other words, the substrate 40 is peeled away from the release surface defined by the outer or upper surface of the conveyor belt 50, or by the release paper 60 if such is being used. By way of illustration, the release paper 60 is shown in FIGS. 3 and 4 moving forwardly and downwardly at an angle relative to both the upper forward section of conveyor belt 50 and the adhesive substrate 40 being peeled away from the same. Thus, when the release paper 60 is being used as the release surface on the adhesive substrate, the release paper diverges away from substrate 40 and, if desired, the release paper 60 may be taken up on a suitably intermittently driven take-up roll 63, as shown in the lower central portion of FIG. 3. If desired, the roll 63 of release paper 60 may be recycled by replacing the supply roll 61, when exhausted, with the roll 63 and drawing the release paper 60 from roll 63 in the subsequent manufacture of pile fabric according to the method of this invention.

In any event, the cured or at least partially cured adhesive substrate 40 of the now completed pile fabric F may be peeled away from the release surface at the discharge end of conveyor 50 by a suitable stripper blade, shown schematically at 100 in FIG. 4. The stripper blade 100 may have a tapered or sharp rear edge and may be stationarily mounted or it may be caused to vibrate or reciprocate in substantially the position shown in FIG. 4 so that its tapered rear edge portion will aid in separating the forwardly moving adhesive substrate 40 from the release surface.

The pile fabric F may be withdrawn and taken up from the region at which the adhesive substrate 40 is being peeled from the release surface by any suitable take-up means. In this instance, it will be observed in the right-hand portions of FIGS. 3 and 4 that the pile fabric F passes from stripper blade 100 onto a suitably driven secondary endless conveyor 110 which preferably has a suitable cooling platen 111 beneath the upper reach thereof for cooling the cured adhesive substrate 40. The secondary conveyor 110 may be driven intermittently by suitable drive connections extending from the main endless conveyor 50 so that both conveyors 50, 110 operate in unison.

The secondary conveyor 110 delivers the fabric F passing thereover into a suitable pit or cavity formed in the floor therebeneath and where the fabric F is suspended in a substantially U-shaped catenary loop 121 as it passes upwardly over a roller 122, past a suitable selvage cutting means or fabric trimming devices 123 and to a suitable fabric take-up mechanism 130 for forming the fabric into a roll 131. The purpose of the loop 121, in the portion of the pile fabric F between the secondary conveyor 110 and the take-up mechanism 130, is to permit the intermittent or stepwise forward movement of the pile fabric F with the forwardly moving upper reaches of the main and secondary endless conveyors 50, 110 during continuous operation of take-up mechanism 130.

The release paper take-up roll 63 may be driven intermittently; i.e., whenever conveyors 50, 91, 110 are driven, by suitable connections with variable speed drive mechanism 80 or, as shown, by means of a separate drive motor 64 (FIG. 3). The operation of motor 64 may be suitably controlled, as by any suitable means which will respond to variations in tension in the release paper 60 between rolls 53, 63, or by any other suitable means, not shown.

It is apparent that the fabric trimming devices 123 may be in the form of suitable rotary blades positioned adjacent opposite sides of the path of travel of the pile fabric for trimming the edges thereof. Each of the blades of selvage trimming devices 123 may be driven by an electric motor 124, and the take-up mechanism 130 may be driven by a suitable electric motor 133.

From the foregoing description, it can be appreciated that, each time pile strand block 10 occupies a position rearwardly or upstream of severing station 70, the pile strands 11 in block 10 are fed or discharged from the open lower end of container 12 in an increment of an amount equal to the desired length of pile. Thereupon, a forward stroke is imparted to pile strand block 10 and, as the leading edge thereof approaches cutter blade 72 of severing station 70, a forward movement of conveyors 50, 91, 110 is initiated.

It is apparent that this initiates a forward or advancing movement of the adhesive substrate 40 previously deposited onto the rear portion of the conveyor 50 or onto the release paper 60 thereon to thus cause adhesive substrate 40 to move downwardly and forwardly from severing station 70 as the corresponding pile slice is being severed from the lower end of pile strand block 10 by cutter blade 72. At the same time that the pile strands are being severed transversely of the pile strand axes by cutter blade 72, the severed pile strands are brought into contact with the layer of adhesive or adhesive substrate 40 for securement of the pile slice thereto and to thereby form transverse rows of cut pile tufts T on the adhesive substrate 40. It is also apparent, that as the pile fabric F thus formed is advanced forwardly along the inclined forward section of the upper reach of main conveyor 50, the adhesive substrate 40 is cured, whereupon the adhesive substrate 40 is separated or peeled from the release surface by the stripper blade 100, and following which the pile fabric is taken up to form the roll 131 thereof as heretofore described.

It should be noted that, as the pile strand block 10 passes forwardly of cutter blade 72, suitable fluid operated rams 16 mounted on the strand block carriage 15 (FIG. 3) are effective in the manner described in my said copending application Ser. No. 363,832, to elevate a frame 17 in which container 12 is secured so as to elevate container 12 and its block of pile strands 11 relative to carriage 15 as container 12 reaches the right-hand end of a stroke in forward movement thereof. Thus, the lower ends of the pile strands will pass above and out of engagement with cutter blade 72 (FIG. 2) in the course of subsequent rearward movement of container 12 from right to left in FIGS. 2, 3, 5 and 7.

It is apparent that, each time carriage 15 and container 12 move rearwardly of severing station 70 in the course of each rearward stroke of carriage 15, the rams 16 are suitably controlled so as to permit container 12 and frame 17 to move downwardly and thereby return to their normal level. The lowering of container 12 to such normal level preferably occurs at about the same time that an increment of the pile strands 11 is discharged from the lower end of container 12 preparatory to a succeeding pile slice being prepared and deposited on the adhesive substrate 40 in the manner heretofore described. It is preferred that the adhesive substrate 40 is stationary in the interim between successive pile slices being severed from the pile strand block 10 so that each successive pile slice may be positioned in proper relation to the immediately preceding pile slice to facilitate the forming of a continuous pile fabric of any desired length, if desired.

Figure 7:
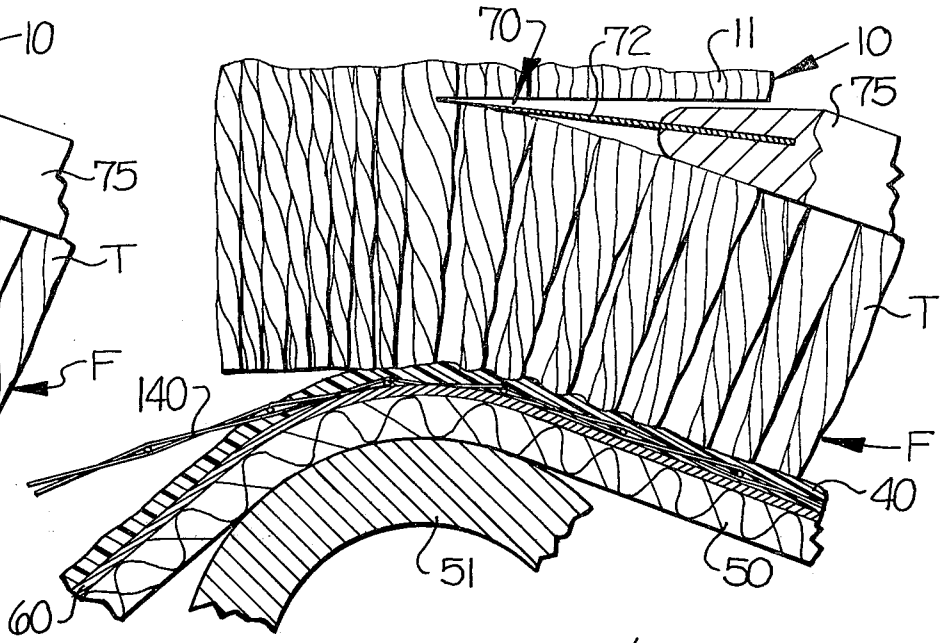
FIG. 7 is a view similar to FIG. 5, but also showing a web of release paper 60 on the conveyor belt 50 and upon which the adhesive substrate is formed with the pile slice secured onto the adhesive substrate.
Figure 5:
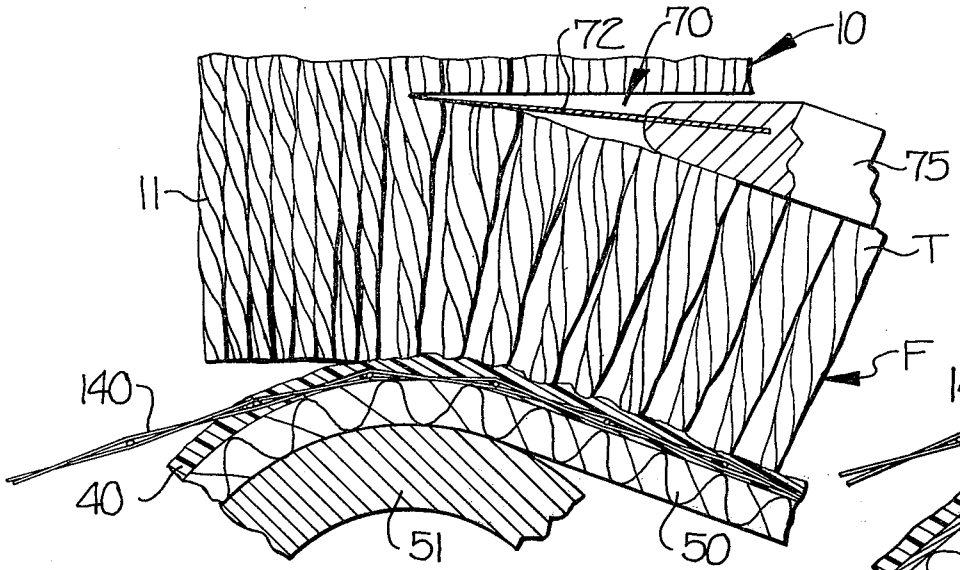
Figure 6:
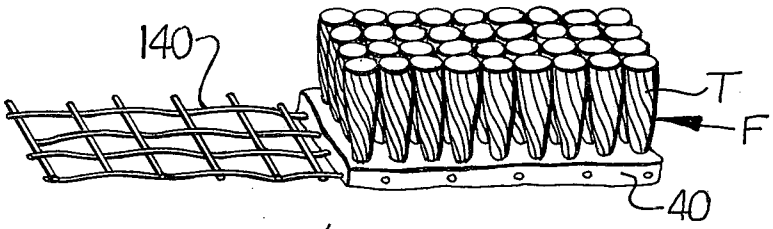
FIG. 6 is a fragmentary perspective view of a portion of the pile fabric of FIG. 5 partially broken away to show the reinforcing scrim and the adhesive substrate.

If so desired, a suitable reinforcing scrim 140, such as a woven fiber-glass fabric, may be drawn from a suitable source of supply 141 (FIG. 3) and directed into and embedded in the adhesive substrate 40, preferably about at the same location at which the cut pile tufts are deposited on the substrate, as shown in FIGS. 5 and 7. Thus, the completed pile fabric with the woven scrim 140 therein may appear substantially as shown in FIG. 6 wherein a portion of the scrim 140 is exposed for purposes of illustration, and the remaining portion of the scrim is embedded in the adhesive substrate 40.

In the drawings and specification, there has been set forth a preferred embodiment of the invention, and although specific terms are employed, they are used in a generic and descriptive sense only and not for purposes of limitation.

That which is claimed is:

1. A method of making pile fabrics, such as carpets, rugs and the like, which comprises providing a pile strand block of substantially parallel strands of pile forming material in an open-ended container, incrementally feeding from the container the pile strand block parallel to the axes of the pile strands in successive increments of an amount equal to the desired length of pile, forming a substrate by depositing a layer of adhesive onto a release surface, severing each successive fed increment of pile strands transversely of the pile strand axes to form a pile slice while bringing the severed pile slice into contact with the layer of adhesive for securement thereto and to form cut pile tufts thereon, and then separating from the release surface the substrate with the cut pile tufts thereon.

2. A method according to claim 1, which includes applying an adhesive coating to the end of each successive fed increment of the pile strand block before severing the respective pile slice therefrom.

3. A method of making pile fabrics, such as carpets, rugs and the like, which comprises providing a pile strand block of rows of substantially parallel strands of pile forming material in an open-ended container, incrementally feeding from the container the pile strand block parallel to the axes of the pile strands in successive increments of an amount equal to the desired length of pile, forming an adhesive substrate by depositing a layer of adhesive onto a release surface, progressively severing the pile strands of each successive fed increment of the pile strand block transversely of the axes of the pile strands to form a respective pile slice thereof while progressively depositing the severed pile strands onto the previously formed adhesive substrate for securement thereto and to form rows of cut pile tufts thereon, while advancing the release surface with the substrate thereon relative to the block of pile strands, then curing the adhesive substrate on the release surface, and peeling the substrate away from the release surface to form the pile fabric.

4. A method according to claim 3, in which the step of forming the adhesive substrate includes depositing the layer of adhesive onto a forwardly moving belt having the release surface thereon.

5. A method according to claim 3, wherein the step of forming the adhesive substrate includes depositing the layer of adhesive onto a release paper having the release surface thereon.

6. A method according to claim 5, wherein the step of peeling the substrate away from the release surface comprises moving the release paper in a path diverging with respect to the path of the advancing substrate.

7. A method according to claim 6, which further comprises the step of taking up the release paper as the adhesive substrate is being peeled from the release surface of the release paper.

8. A method according to claim 3, which includes embedding a reinforcing scrim in the layer of adhesive after the depositing thereof onto the release surface.

9. A method according to claim 3, which includes, following the depositing of the severed pile strands onto the adhesive substrate, the step of pressing the successive deposited severed pile strands and the adhesive substrate together to aid in securing the deposited severed pile strands to the adhesive substrate.

10. A method according to claim 3, which includes moving the block of pile strands over the previously formed adhesive substrate and over a stationarily mounted severing means in the same general direction as that in which the adhesive substrate is being advanced during the severing of the pile strands and the depositing of the severed pile strands onto the adhesive substrate.

11. A method according to claim 10, in which the advancing of the adhesive substrate comprises advancing the same at a faster rate than that at which the block of pile strands is being moved to obtain a desired density of the rows of cut pile tufts on the adhesive substrate.

* * * * *